US005898942A

United States Patent [19]

Anderson

[11] Patent Number: 5,898,942

[45] Date of Patent: May 4, 1999

[54] SAFETY GLOVE

[76] Inventor: Thomas R. Anderson, 215 W. Manchester St., Lowell, Mass. 01852

[21] Appl. No.: 09/095,982

[22] Filed: Jun. 11, 1998

[51] Int. Cl.[6] ..... A41D 19/00

[52] U.S. Cl. ..... 2/159; 2/158; 2/160; 2/161.6

[58] Field of Search ..... 2/16, 158, 159, 2/160, 161.1, 161.6, 163, 167, 169, 917

[56] References Cited

U.S. PATENT DOCUMENTS

| | | | |
|---|---|---|---|
| Re. 16,272 | 2/1926 | Green | 2/160 |
| 1,244,065 | 10/1917 | Miller | 2/159 |
| 1,624,429 | 4/1927 | Palmer | 2/159 |
| 1,630,730 | 5/1927 | Daugherty | 2/159 |
| 1,966,822 | 7/1934 | Lieb | 2/160 |
| 4,519,781 | 5/1985 | Boyd | 2/160 |

FOREIGN PATENT DOCUMENTS

| | | | |
|---|---|---|---|
| 616134 | 3/1961 | Canada | 2/159 |

*Primary Examiner*—John J. Calvert
*Assistant Examiner*—Gary L. Welch

[57] ABSTRACT

A new safety glove for allowing a user, such as a police officer or a road worker, to direct traffic more easily. The inventive device includes a hand cover having an interior hand space, a front, a back, a palm portion, and a wrist opening into the interior hand space. Also provided are front and back reflective panels. The front reflective panel is coupled to the front of the hand cover and the back reflective panel is coupled to the back of the hand cover.

3 Claims, 2 Drawing Sheets

SAFETY GLOVE

BACKGROUND OF THE INVENTION

1. Field of the Invention

The present invention relates to glove devices and more particularly pertains to a new safety glove for allowing a user, such as a police officer or a road worker, to direct traffic more easily.

2. Description of the Prior Art

The use of glove devices is known in the prior art. More specifically, glove devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art glove devices include U.S. Pat. No. Des. 369,309; U.S. Pat. No. 1,966,822; U.S. Pat. No. 4,270,228; U.S. Pat. No. Des. 282,981; U.S. Pat. No. Des. 372,112; and U.S. Pat. No. Des. 293,850.

While these devices fulfill their respective, particular objectives and requirements, the aforementioned patents do not disclose a new safety glove. The inventive device includes a hand cover having an interior hand space, a front, a back, a palm portion, and a wrist opening into the interior hand space. Also provided are front and back reflective panels. The front reflective panel is coupled to the front of the hand cover and the back reflective panel is coupled to the back of the hand cover.

In these respects, the safety glove according to the present invention substantially departs from the conventional concepts and designs of the prior art, and in so doing provides an apparatus primarily developed for the purpose of allowing a user, such as a police officer or a road worker, to direct traffic more easily.

SUMMARY OF THE INVENTION

In view of the foregoing disadvantages inherent in the known types of glove devices now present in the prior art, the present invention provides a new safety glove construction wherein the same can be utilized for allowing a user, such as a police officer or a road worker, to direct traffic more easily.

The general purpose of the present invention, which will be described subsequently in greater detail, is to provide a new safety glove apparatus and method which has many of the advantages of the glove devices mentioned heretofore and many novel features that result in a new safety glove which is not anticipated, rendered obvious, suggested, or even implied by any of the prior art glove devices, either alone or in any combination thereof.

To attain this, the present invention generally comprises a hand cover having an interior hand space, a front, a back, a palm portion, and a wrist opening into the interior hand space. Also provided are front and back reflective panels. The front reflective panel is coupled to the front of the hand cover and the back reflective panel is coupled to the back of the hand cover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new safety glove apparatus and method which has many of the advantages of the glove devices mentioned heretofore and many novel features that result in a new safety glove which is not anticipated, rendered obvious, suggested, or even implied by any of the prior art glove devices, either alone or in any combination thereof.

It is another object of the present invention to provide a new safety glove which may be easily and efficiently manufactured and marketed.

It is a further object of the present invention to provide a new safety glove which is of a durable and reliable construction.

An even further object of the present invention is to provide a new safety glove which is susceptible of a low cost of manufacture with regard to both materials and labor, and which accordingly is then susceptible of low prices of sale to the consuming public, thereby making such safety glove economically available to the buying public.

Still yet another object of the present invention is to provide a new safety glove which provides in the apparatuses and methods of the prior art some of the advantages thereof, while simultaneously overcoming some of the disadvantages normally associated therewith.

Still another object of the present invention is to provide a new safety glove for allowing a user, such as a police officer or a road worker, to direct traffic more easily.

Yet another object of the present invention is to provide a new safety glove which includes a hand cover having an interior hand space, a front, a back, a palm portion, and a wrist opening into the interior hand space. Also provided are front and back reflective panels. The front reflective panel is coupled to the front of the hand cover and the back reflective panel is coupled to the back of the hand cover.

Still yet another object of the present invention is to provide a new safety glove that has reflective panels for reflecting light so that others can easily see the hands of the user. This is very helpful when directing vehicular traffic by hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
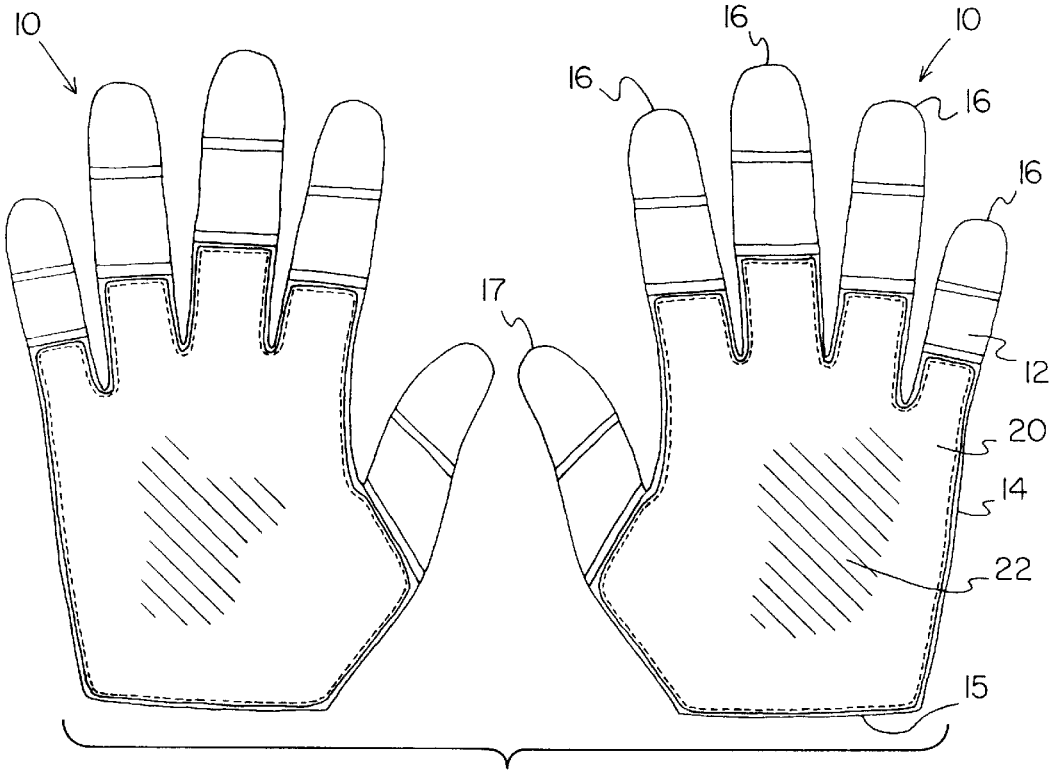
FIG. 1 is a schematic side view of the front of a pair of glove embodiment hand covers of a new safety glove according to the present invention.

As best illustrated in FIGS. 1 through 5, the safety glove generally comprises a hand cover 10,11 having an interior hand space, a front 12, a back 13, a palm portion 14, and a wrist opening 15 into the interior hand space. Also provided are front and back reflective panels 20,21. The front reflective panel 20 is coupled to the front 12 of the hand cover and the back reflective panel 21 is coupled to the back 13 of the hand cover.

Figure 2:
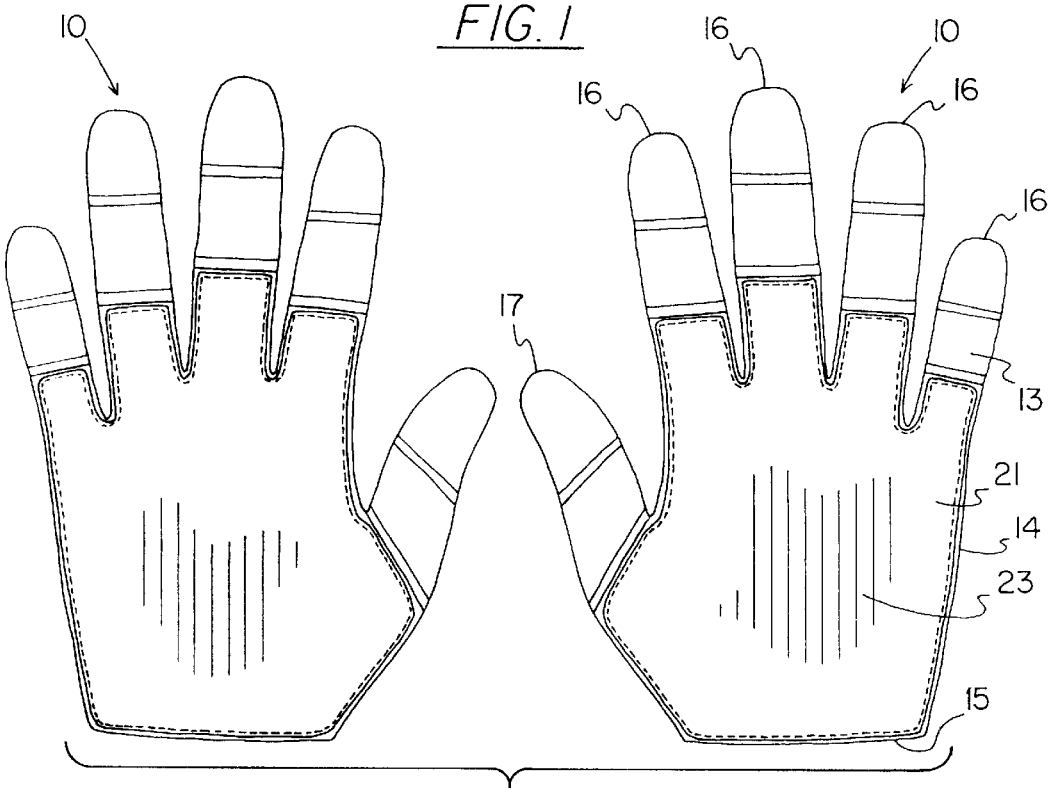
FIG. 2 is a schematic side view of the back of a pair of glove embodiment hand covers of the present invention.
Figure 3:
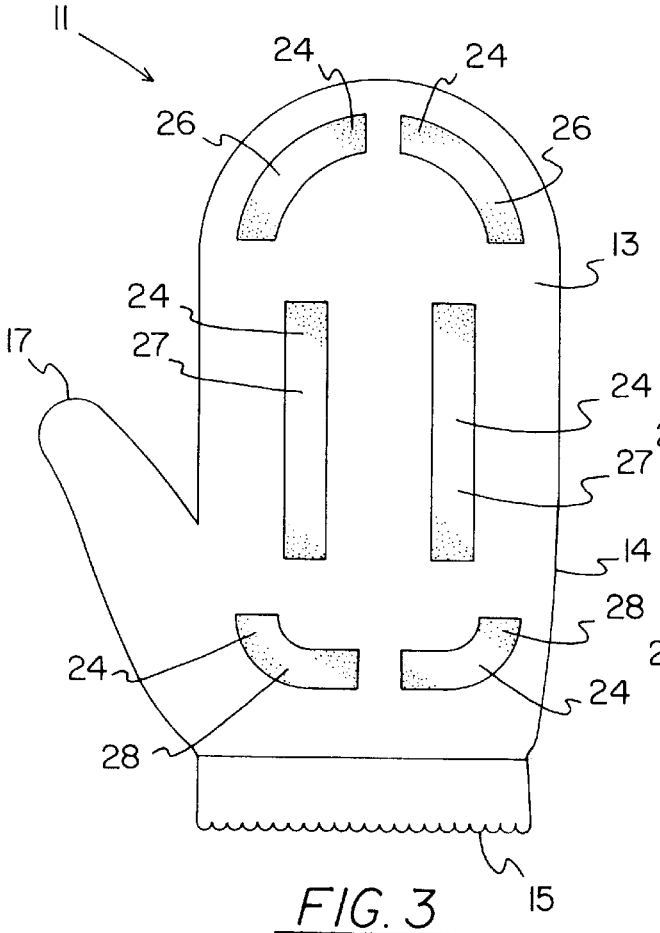
FIG. 3 is a schematic side view of the mitten embodiment of the present invention.
Figure 4:
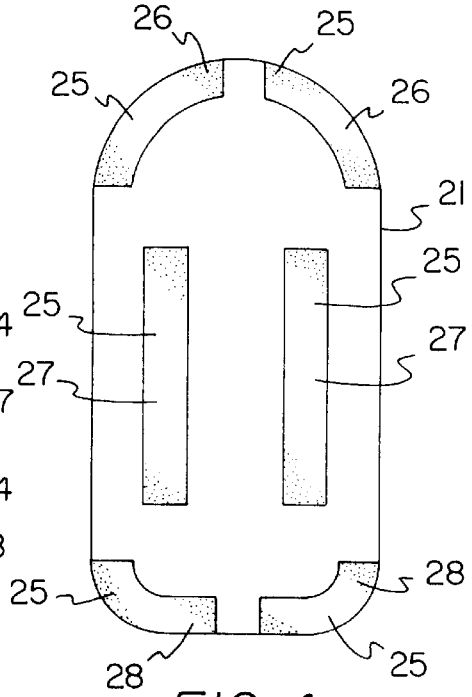
FIG. 4 is a schematic side view of a reflective panel detached from the mitten embodiment of FIG. 3.
Figure 5:
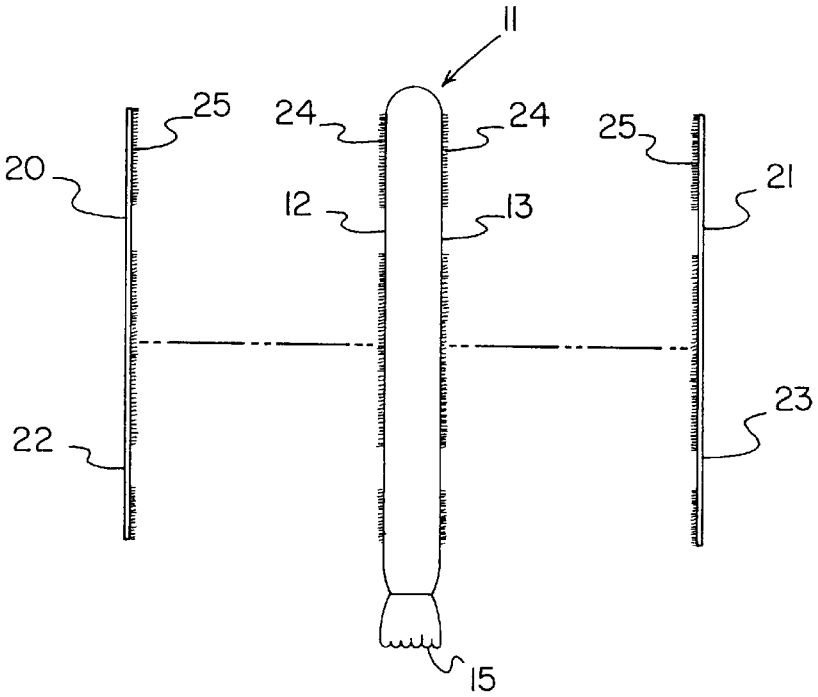
FIG. 5 is a schematic exploded side view of the mitten embodiment of the present invention.

In closer detail, as illustrated in the Figures, the safety hand garment preferably includes left and right hand covers. As illustrated in FIGS. 1 and 2, Ideally, the hand cover may comprise a glove 10 having a plurality of finger portions 16 and a thumb portion 17 or a mitten 11 having a thumb portion 17. In either embodiment each hand cover has an interior hand space, a front 12, a back 13, a palm portion 14, and a wrist opening 15 into the interior hand space.

Also provided are front and back reflective panels 20,21. The front reflective panel 20 is coupled to the front 12 of the hand cover while the back reflective panel 21 is coupled to the back 13 of the hand cover. Preferably, the reflective panels are detachably coupled to the hand cover such that the reflective panels can be detached from the hand cover when not needed or when they need to be replaced due to damage. Ideally, hook and loop fasteners 24,25 detachably attach the reflective panels to the hand cover. As illustrated on the mitt embodiment 11, each hook and loop fastener comprises a pair of detachably attachable complementary strips 24,25. One of the strips is provided on the exterior of the hand cover while the complementary strip is provided on the back of the respective reflective panel.

The reflective panels 20,21 each have a reflective outer surface 22,23 designed for reflecting light. The reflective surface 22 of the front reflective panel 20 is of a first color such that light of the first color is reflected to be viewed by others. The reflective surface 23 of the back reflective panel 21 is of a second color such that light of the second color is reflected to be viewed by others. Preferably, first color is distinguishable from the second color. Ideally, the first color is red for symbolizing "stop" when directing traffic with the hand cover and the second color is green for symbolizing "go" when directing traffic with the hand cover.

The reflective panels 20,21 are positioned on the palm portion 14 of the hand cover. In the glove embodiment 10, the reflective panels 20,21 cover the palm portion 14 of the glove and about the lower half to one-third of each finger portion adjacent the palm portion 14 of the glove. In the mitten embodiment 11, the reflective panels 20,21 are generally oblong so that they cover the palm portion 14 of the mitten including the regions of the palm portion 14 of the mitten than enclose the fingers of a wearer. In the mitten embodiment, ideally, the hook and loop fastener strips are arranged on the mitten embodiment with a pair of arcuate strips 26 positioned towards the finger tip region of the palm portion 14 of the mitten and another pair of arcuate strips 28 positioned towards the wrist opening 15 with complementary arcuate strips positioned adjacent the ends of the associated reflective panel. A third pair of elongate rectangular strips 27 is positioned between the two pairs of arcuate strips with a similarly position third pair of strips on the associated reflective panel.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A safety hand garment, comprising:

left and right hand covers each having a hand cover having an interior hand space, a front with a lower portion, a back with a lower portion, and a wrist opening into said interior hand space; and front and back reflective panels;

said reflective panels each having a reflective outer surface being for reflecting light;

said reflective surface of said front reflective panel being a first color such that light of said first color is reflected to be viewed by others, said reflective surface of said back reflective panel being a second color, first color being distinguishable from said second color, wherein said first color is red for symbolizing "stop" when directing traffic with the hand cover, wherein said second color is green for symbolizing "go" when directing traffic with the hand cover;

said reflective panels being positioned on said lower portions of said hand cover;

wherein said front and back of said hand cover comprises a glove having a plurality of finger portions and a thumb portion;

wherein a periphery of the reflective panels extend along an entire periphery of the lower portions of the hand cover and a portion of the finger portions such that said reflective panels expose the thumb portions and cover said lower portions of said glove and about the lower one-third of each finger portion adjacent the lower portions of said glove and terminate with a linear edge at a second knuckle of the finger portions.

2. A safety hand garment, comprising:

left and right hand covers each having a hand cover having an interior hand space, a front, a back, and a wrist opening into said interior hand space;

front and back reflective panels;

said reflective panels each having a reflective outer surface being for reflecting light;

said reflective surface of said front reflective panel being a first color such that light of said first color is reflected to be viewed by others, said reflective surface of said back reflective panel being a second color, first color being distinguishable from said second color, wherein said first color is red for symbolizing "stop" when directing traffic with the hand cover, wherein said second color is green for symbolizing "go" when directing traffic with the hand cover;

wherein said hand cover comprises a mitten having a thumb portion;

wherein a periphery of the reflective panels extend along an entire periphery of the hand cover such that said reflective panels are generally oblong with a pair of linear sides, an arcuate top edge and a linear bottom edge so that they cover said mitten and expose the thumb portion of the hand cover.

3. A safety hand garment, comprising:

left and right hand covers each having a hand cover having an interior hand space, a front, a back, and a wrist opening into said interior hand space; and front and back reflective panels detachably coupled to said front and back of said hand cover, respectively;

wherein hook and loop fasteners detachably attach said reflective panels to said hand cover;

said reflective panels each having a reflective outer surface being for reflecting light;

said reflective surface of said front reflective panel being a first color such that light of said first color is reflected to be viewed by others, said reflective surface of said back reflective panel being a second color, first color being distinguishable from said second color, wherein said first color is red for symbolizing "stop" when directing traffic with the hand cover, wherein said second color is green for symbolizing "go" when directing traffic with the hand cover;

wherein said hand cover comprises a mitten having a thumb portion;

wherein a periphery of the reflective panels extend along an entire periphery of the lower portion of the hand cover such that said reflective panels are generally oblong with a pair of linear sides, an arcuate top edge and a linear bottom edge so that they cover said mitten and expose the thumb portion of the hand cover;

wherein said hook and loop fastener includes a pair of arcuate strips positioned towards a finger tip region of the mitten and another pair of arcuate strips positioned towards the wrist opening and a third pair of elongate rectangular strips being positioned between the two pairs of arcuate strips in parallel relationship and spaced together a distance less than that spanned by ends of the arcuate strips.

* * * * *